US007236077B1

(12) United States Patent
Hsu

(10) Patent No.: US 7,236,077 B1
(45) Date of Patent: Jun. 26, 2007

(54) TRANSFORMER HAVING ADJUSTABLE LEAKAGE INDUCTANCE

(75) Inventor: Wen-Kuan Hsu, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/565,115

(22) Filed: Nov. 30, 2006

(30) Foreign Application Priority Data

Oct. 5, 2006 (TW) ..... 95137197 A

(51) Int. Cl.
*H01F 27/28* (2006.01)

(52) U.S. Cl. ..... 336/180; 336/208; 336/182

(58) Field of Classification Search ..... 336/212, 336/208, 198, 192, 180–182
See application file for complete search history.

(56) References Cited

U.S. PATENT DOCUMENTS 4,229,786 A * 10/1980 Mitani et al. ..... 363/126
4,857,878 A * 8/1989 Eng et al. ..... 336/192
4,968,106 A * 11/1990 Ikeuchi et al. ..... 315/411
6,449,178 B1 * 9/2002 Sakai et al. ..... 363/131
7,038,397 B2 * 5/2006 Komatsu et al. ..... 315/276
2002/0070833 A1 * 6/2002 Junjie et al. ..... 336/198

* cited by examiner

*Primary Examiner*—Anh Mai

(57) ABSTRACT

A transformer having adjustable leakage inductance includes a primary winding coil, a secondary winding coil, a bobbin and a magnetic core assembly. The bobbin includes a winding section for winding the primary winding coil and the secondary winding coil thereon, wherein the bobbin further includes a channel therein. The magnetic core assembly is partially embedded into the channel of the first bobbin. The primary winding coil and the secondary winding coil are partially overlapped with each other and wound around the winding section of the bobbin to be defined as an overlap region. The region where the primary winding coil and the secondary winding coil are not overlapped with each other is defined as a non-overlap region. The leakage inductance of the transformer is adjusted according to an overlap ratio of the overlap region to the sum of the overlap region and the non-overlap region.

18 Claims, 7 Drawing Sheets

TRANSFORMER HAVING ADJUSTABLE LEAKAGE INDUCTANCE

FIELD OF THE INVENTION

The present invention relates to a transformer, and more particularly to a transformer having adjustable leakage inductance.

BACKGROUND OF THE INVENTION

A transformer has become an essential electronic component for various kinds of electric appliances. Referring to FIG. 1, a schematic exploded view of a conventional transformer is illustrated. The transformer 1 principally comprises a magnetic core assembly 11, a bobbin 12, a primary winding coil 13 and a secondary winding coil 14. The primary winding coil 13 and the secondary winding coil 14 are overlapped with each other and wound around a winding section 121 of the bobbin 12. A tape 15 is provided for isolation and insulation. The magnetic core assembly 11 includes a first magnetic part 111 and a second magnetic part 112. The middle portion 111*a* of the first magnetic part 111 and the middle portion 112*a* of the second magnetic part 112 are embedded into the channel 122 of the bobbin 12. The primary winding coil 13 and the secondary winding coil 14 interact with the magnetic core assembly 11 to achieve the purpose of voltage regulation.

Since the leakage inductance of the transformer has an influence on the electric conversion efficiency of a power converter, it is very important to control leakage inductance. Related technologies were developed to increase coupling coefficient and reduce leakage inductance of the transformer so as to reduce power loss upon voltage regulation. In the transformer of FIG. 1, the primary winding coil 13 and the secondary winding coil 14 are overlapped with each other and wound around the bobbin 12. As a consequence, there is less magnetic flux leakage generated from the primary winding coil 13 and the secondary winding coil 14. The primary winding coil 13 and the secondary winding coil 14 are overlapped with each other and wound around a winding section 121 of the bobbin 12. Under this circumstance, sine the coupling coefficient is increased, the leakage inductance of the transformer is reduced (e.g. less than 10 μH) and the power loss upon voltage regulation is reduced, the electric conversion efficiency of a power converter is enhanced.

In the power supply system of the electric products in the new generation, for example LCD televisions, the transformer with leakage inductance prevails. The current generated from the power supply system will pass through a LC resonant circuit composed of an inductor L and a capacitor C. The inductor L is provided from the primary winding coil of the transformer. Meanwhile, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch and minimize the noise.

In order to increase the leakage inductance of the transformer, the primary winding coil should be separated from the secondary winding coil by a certain distance to reduce the coupling coefficient of the transformer. Referring to FIG. 2, a schematic exploded view of a transformer with leakage inductance according to prior art is illustrated. The transformer 2 principally comprises a magnetic core assembly 21, a bobbin 22, a primary winding coil 23, a secondary winding coil 24 and a tape 25. The bobbin 22 comprises a first side plate 221, a second side plate 222 and a winding member 223. The tape 25 is wound around the middle portion of the winding member 223 and has a width d. The winding member 223 is divided into a first winding section 2231 and a second winding section 2232, which are located at bilateral sides of the tape 25. The primary winding coil 23 and the secondary winding coil 24 are wound around the first winding section 2231 and the second winding section 2232, respectively. For safety regulations, the tape 25 is used for isolation between the primary winding coil 23 and the secondary winding coil 24. As the width d of the tape 25 between the primary winding coil 23 and the secondary winding coil 24 is increased, the coupling coefficient is reduced and the leakage inductance of the transformer is increased. Under this circumstance, the resonant circuit of the power supply system will be conveniently controlled.

Although the transformer of FIG. 2 is advantageous for increasing the leakage inductance, some drawbacks still exist. For example, since the primary winding coil 23 and the secondary winding coil 24 are separated by the tape 25, the coupling coefficient is reduced and the leakage inductance is too high (e.g. greater than 50 μH) to be lowered or adjusted.

As previously described, the transformer of FIG. 1 or FIG. 2 fails to adjust the leakage inductance within an acceptable range.

In views of the above-described disadvantages, the applicant keeps on carving unflaggingly to develop a transformer having adjustable leakage inductance according to the present invention through wholehearted experience and research.

SUMMARY OF THE INVENTION

It is an object of the present invention to provide a transformer whose leakage inductance is adjustable within an acceptable range.

In accordance with an aspect of the present invention, there is provided a transformer having adjustable leakage inductance. The transformer includes a primary winding coil, a secondary winding coil, a bobbin and a magnetic core assembly. The bobbin includes a winding section for winding the primary winding coil and the secondary winding coil thereon, wherein the bobbin further includes a channel therein. The magnetic core assembly is partially embedded into the channel of the first bobbin. The primary winding coil and the secondary winding coil are partially overlapped with each other and wound around the winding section of the bobbin to be defined as an overlap region. The region where the primary winding coil and the secondary winding coil are not overlapped with each other is defined as a non-overlap region. The leakage inductance of the transformer is adjusted according to an overlap ratio of the overlap region to the sum of the overlap region and the non-overlap region.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
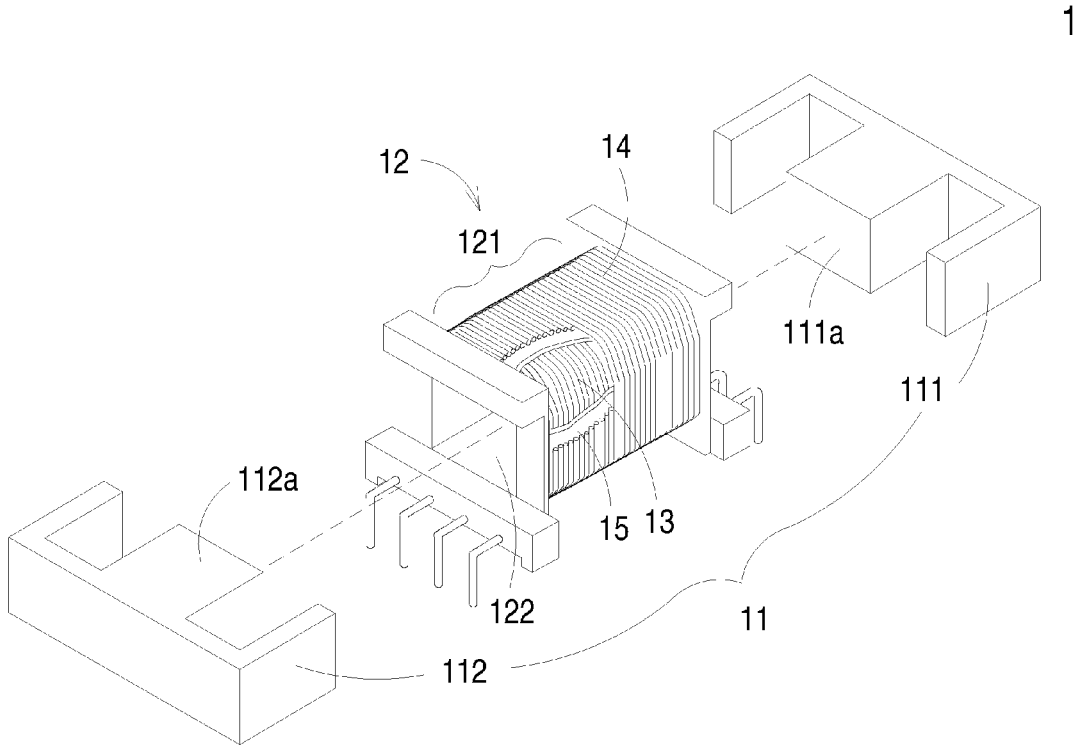
Fig. 1 Prior Art
FIG. 1 is a schematic exploded view of a conventional transformer.
Figure 2:
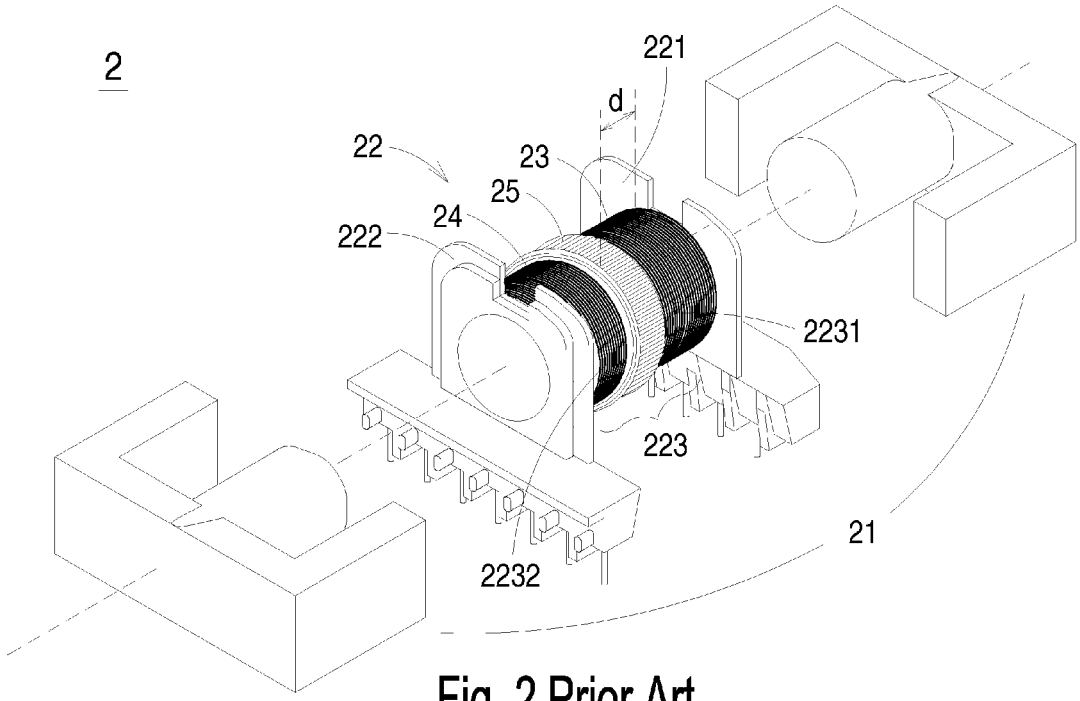
Fig. 2 Prior Art
FIG. 2 is a schematic exploded view of another conventional transformer with leakage inductance.
Figure 3:
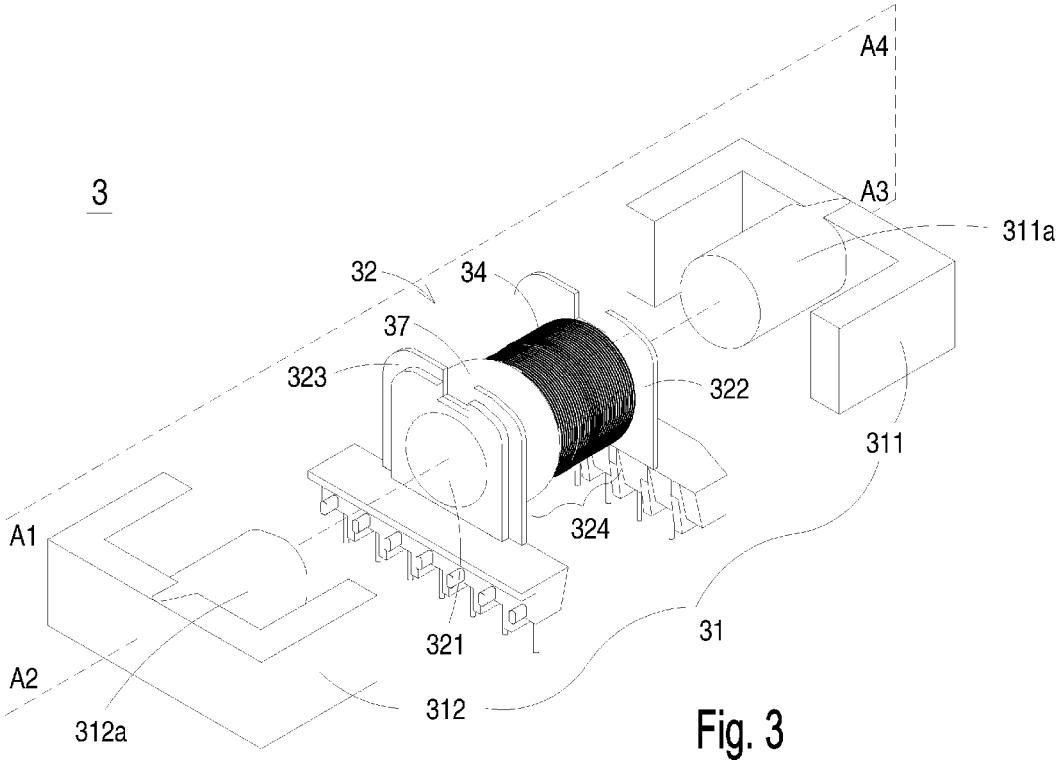
FIG. 3 is a schematic exploded view of a transformer according to a preferred embodiment of the present invention.
Figure 4:
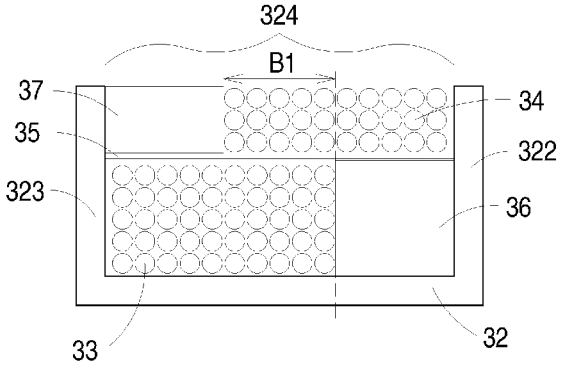
FIG. 4 is a schematic cross-sectional view illustrating a winding structure of the transformer taken along the cross-section A1A2A3A4.

Referring to FIG. 3, a schematic exploded view of a transformer according to a preferred embodiment of the present invention is illustrated. FIG. 4 is a schematic cross-sectional view of the transformer taken along the cross-section A1A2A3A4. As shown in FIG. 3 and FIG. 4, the transformer 3 principally comprises a magnetic core assembly 31, a bobbin 32, a primary winding coil 33 and a secondary winding coil 34. The magnetic core assembly 31 of the transformer 3 includes a first magnetic part 311 and a second magnetic part 312, which are cooperatively formed as an EE-type core assembly, an EI-type core assembly, an ER-type core assembly, a UU-type core assembly or a UI-type core assembly. The middle portion 311*a* of the first magnetic part 311 and the middle portion 312*a* of the second magnetic part 312 are embedded into the channel 321 of the bobbin 32. The primary winding coil 33 and the secondary winding coil 34 interact with the magnetic core assembly 31 to achieve the purpose of voltage regulation.

The bobbin 32 comprises a first side plate 322, a second side plate 323 and a winding section 324. The winding section 324 is disposed between the first side plate 322 and the second side plate 323. The primary winding coil 33 and the secondary winding coil 34 are wound around the winding section 324. In a case that the primary winding coil 33 and the secondary winding coil 34 have no insulating covering, the primary winding coil 33 is separated from the secondary winding coil 34 by the insulating element 35. An example of the insulating element 35 is an insulating tape.

In some embodiments, the primary winding coil 33 and the secondary winding coil 34 are partially overlapped with each other and wound around the winding section 324 of the bobbin 32. For example, as shown in FIG. 4, the primary winding coil 33 and the secondary winding coil 34 are overlapped with each other at the overlap region B1. The region where the primary winding coil 33 and the secondary winding coil 34 are not overlapped with each other is referred as a non-overlap region. For illustration, the ratio of the overlap region to the sum of the overlap region and the non-overlap region is referred hereinafter as an overlap ratio.

In accordance with a specified feature of the present invention, the coupling coefficient and the leakage inductance of the transformer are adjustable by controlling the overlap ratio. As the overlap ratio is increased, the coupling coefficient is increased but the leakage inductance is lowered. Whereas, as the overlap ratio is decreased, the coupling coefficient is lowered but the leakage inductance is heightened.

Please refer to FIG. 3 and FIG. 4. The transform 3 further includes a first adjusting element 36 and a second adjusting element 37 for adjusting the overlap ratio. The first adjusting element 36 is protruded from or attached onto the first side plate 322 and disposed between the first side plate 322 and the second side plate 323. An example of the first adjusting element 36 is a stop block and integrally formed with the bobbin 32. Alternatively, the first adjusting element 36 may be a stop wall formed by winding an insulating tape around the winding section 324. Since a certain space of the winding section 324 is occupied by the first adjusting element 36, the remainder of the winding section 324 is responsible for winding the primary winding coil 33 thereon. That is, the primary winding coil 33 is wound around the winding section 324 between the second side plate 323 and the first adjusting element 36. In a case that the primary winding coil 33 have no insulating covering, the insulating element 35 (e.g. an insulating tape) is wrapped around the primary winding coil 33 and the first adjusting element 36.

Subsequently, the second adjusting element 37 is placed on the insulating element 35. The second adjusting element 37 is protruded from or attached onto the second side plate 323 of the bobbin 32 and disposed between the first side plate 322 and the second side plate 323. An example of the second adjusting element 37 is a movable stop block. Alternatively, the second adjusting element 37 may be a stop wall formed by winding an insulating tape around the insulating element 35. Likewise, since a certain space of the winding section 324 is occupied by the second adjusting element 37, the remainder of the winding section 324 is responsible for winding the secondary winding coil 34 thereon. That is, the secondary winding coil 34 is wound around the winding section 324 between the first side plate 322 and the second adjusting element 37.

From the above description, the overlap ratio between the primary winding coil 33 and the secondary winding coil 34 is adjusted by changing the width and the location of the first adjusting element 36 and/or the second adjusting element 37. After a specific overlap ratio is selected, the coupling coefficient and the leakage inductance of the transformer 3 are determined.

Figure 5:
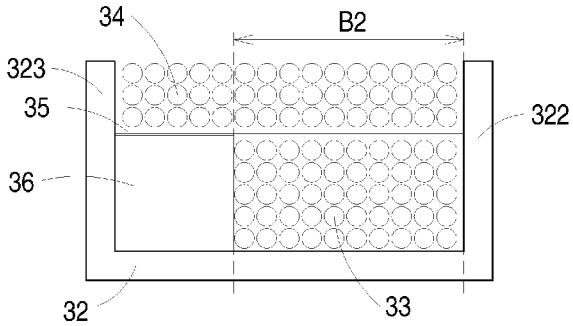
FIGS. 5-9 are schematic cross-sectional views illustrating other winding structures of the transformer.

A further embodiment of a transformer having adjustable leakage inductance is illustrated in FIG. 5. The magnetic core assembly 31, the bobbin 32, the primary winding coil 33 and the secondary winding coil 34 included therein are similar to those shown in FIGS. 3 and 4, and are not redundantly described herein. In this embodiment, the first adjusting element 36 is protruded from or attached onto the second side plate 323 and disposed between the first side plate 322 and the second side plate 323. After the insulating element 35 is wrapped around the primary winding coil 33 and the first adjusting element 36, the secondary winding coil 34 is wound around the winding section 324 between the first side plate 322 and the second side plate 323 and above the insulating element 35. As shown in FIG. 5, the primary winding coil 33 and the secondary winding coil 34 are overlapped with each other at the overlap region B2. By setting the overlap ratio between the primary winding coil 33 and the secondary winding coil 34, the coupling coefficient and the leakage inductance of the transformer 3 are determined.

Figure 6:
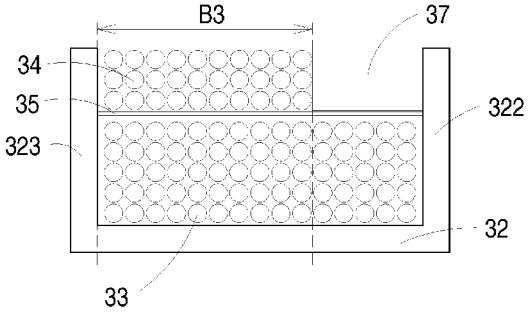

A further embodiment of a transformer having adjustable leakage inductance is illustrated in FIG. 6. The magnetic core assembly 31, the bobbin 32, the primary winding coil 33 and the secondary winding coil 34 included therein are similar to those shown in FIGS. 3 and 4, and are not redundantly described herein. In this embodiment, only the second adjusting element 37 is used. After the primary winding coil 33 is wound around the winding section 324 between the first side plate 322 and the second side plate 323, the insulating element 35 is wrapped around the primary winding coil 33. Subsequently, the second adjusting element 37 is placed on the insulating element 35. The second adjusting element 37 is protruded from or attached onto the first side plate 322 of the bobbin 32 and disposed between the first side plate 322 and the second side plate 323. As shown in FIG. 6, the primary winding coil 33 and the secondary winding coil 34 are overlapped with each other at the overlap region B3. By setting the overlap ratio between the primary winding coil 33 and the secondary winding coil 34, the coupling coefficient and the leakage inductance of the transformer 3 are determined.

Figure 7:
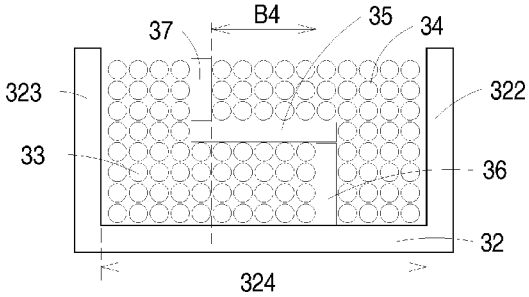

A further embodiment of a transformer having adjustable leakage inductance is illustrated in FIG. 7. The magnetic core assembly 31, the bobbin 32, the primary winding coil 33 and the secondary winding coil 34 included therein are similar to those shown in FIGS. 3 and 4, and are not redundantly described herein. In this embodiment, the first adjusting element 36 is arranged between the first side plate 322 and the second side plate 323. The first adjusting element 36 is distant from the first side plate 322 and the second side plate 323. The first adjusting element 36 is a partition plate formed by winding an insulating tape around the surface of the bobbin 32. For example, a first portion of the primary winding coil 33 is partially wound around the winding section 324 from the first adjusting element 36 toward the second side plate 323 such that the outer periphery of the first portion is substantially at the same level as the first adjusting element 36. Then, a second portion of the primary winding coil 33 is continuously wound around the winding section 324 toward the second side plate 323 such that the outer periphery of the primary winding coil 33 is higher than the insulating element 35 with respect to the bobbin 32. In a case that the primary winding coil 33 have no insulating covering, the insulating element 35 is wrapped around the first portion of the primary winding coil 33 and the first adjusting element 36. Subsequently, the second adjusting element 37 is arranged on the insulating element 35. The second adjusting element 37 is distant from the first side plate 322 and the second side plate 323. The second adjusting element 37 is also a partition plate formed by winding an insulating tape around an edge of the insulating element 35. Then, a first portion of the secondary winding coil 34 is partially wound around the winding section 324 from the second adjusting element 37 toward the first side plate 322. Then, a second portion of the secondary winding coil 34 is continuously wound around the winding section 324 toward the first side plate 322. As shown in FIG. 7, the primary winding coil 33 and the secondary winding coil 34 are overlapped with each other at the overlap region B4. By setting the overlap ratio between the primary winding coil 33 and the secondary winding coil 34, the coupling coefficient and the leakage inductance of the transformer 3 are determined.

Figure 8:
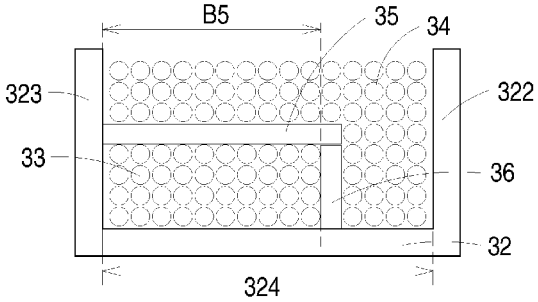

A further embodiment of a transformer having adjustable leakage inductance is illustrated in FIG. 8. The magnetic core assembly 31, the bobbin 32, the primary winding coil 33 and the secondary winding coil 34 included therein are similar to those shown in FIGS. 3 and 7, and are not redundantly described herein. In this embodiment, the first adjusting element 36 is arranged between the first side plate 322 and the second side plate 323. The first adjusting element 36 is distant from the first side plate 322 and the second side plate 323. The first adjusting element 36 is a partition plate formed by winding an insulating tape around the surface of the bobbin 32. The primary winding coil 33 is wound around the winding section 324 between the first adjusting element 36 and the second side plate 323 such that the outer periphery of the primary winding coil 33 is substantially at the same level as the first adjusting element 36. Then, the insulating element 35 is wrapped around the primary winding coil 33 and the first adjusting element 36. Then, the secondary winding coil 34 is wound around the insulating element 35 and the surface of the bobbin 32. As shown in FIG. 8, the primary winding coil 33 and the secondary winding coil 34 are overlapped with each other at the overlap region B5. By setting the overlap ratio between the primary winding coil 33 and the secondary winding coil 34, the coupling coefficient and the leakage inductance of the transformer 3 are determined.

Figure 9:
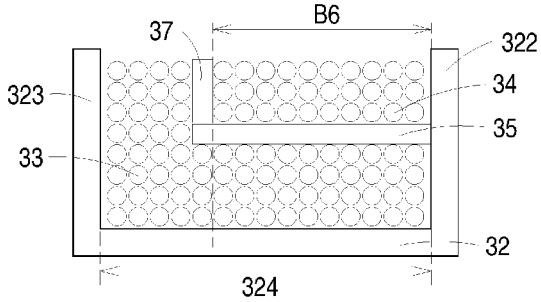

A further embodiment of a transformer having adjustable leakage inductance is illustrated in FIG. 9. The magnetic core assembly 31, the bobbin 32, the primary winding coil 33 and the secondary winding coil 34 included therein are similar to those shown in FIGS. 3 and 7, and are not redundantly described herein. A first portion of the primary winding coil 33 is partially wound around the winding section 324 from the first side plate 322 toward the second side plate 323. Then, the insulating element 35 is wrapped around the first portion of the primary winding coil 33. Subsequently, the second adjusting element 37 is arranged on the insulating element 35. The second adjusting element 37 is distant from the first side plate 322 and the second side plate 323. The second adjusting element 37 is also a partition plate formed by winding an insulating tape around an edge of the insulating element 35. Afterwards, the second portion of the primary winding coil 33 is wound around the winding section 324 between the second side plate 323 and the second adjusting element 37. The secondary winding coil 34 is wound around the insulating element 35 and between said first side plate 322 and said second adjusting element 37. As shown in FIG. 9, the primary winding coil 33 and the secondary winding coil 34 are overlapped with each other at the overlap region B6. By setting the overlap ratio between the primary winding coil 33 and the secondary winding coil 34, the coupling coefficient and the leakage inductance of the transformer 3 are determined.

In the above embodiments, an additional primary winding coil (not shown) may be wound around the outer peripheries of the primary winding coil 33 and the secondary winding coil 34, thereby changing the coupling coefficient and the leakage inductance of the transformer 3.

Figure 10:
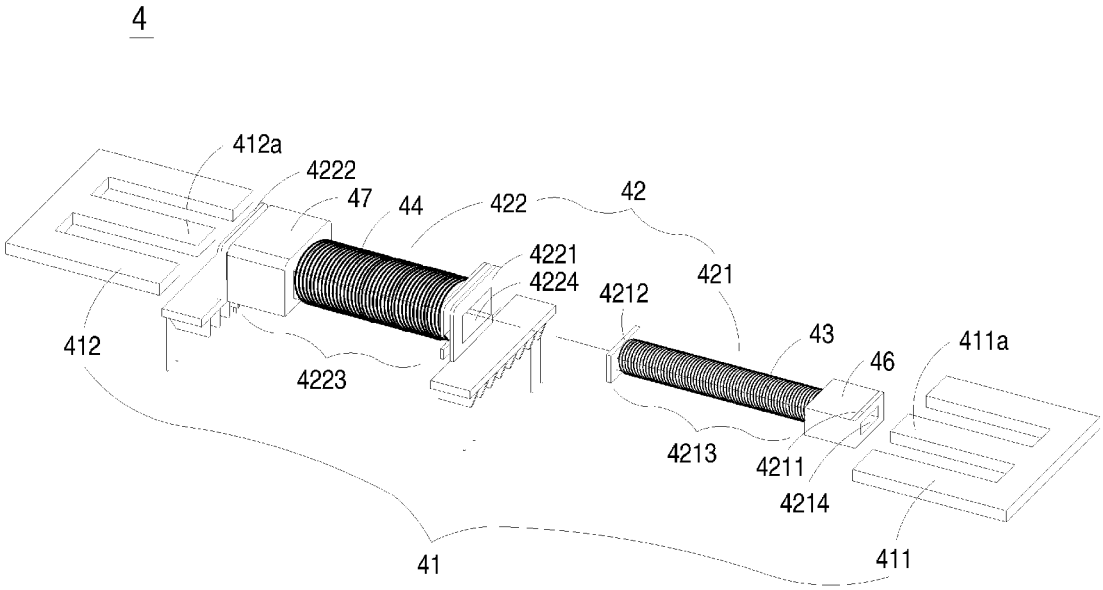
FIG. 10 is a schematic exploded view of a transformer according to a further preferred embodiment of the present invention.

Referring to FIG. 10, a schematic exploded view of a transformer according to another preferred embodiment of the present invention is illustrated. As shown in FIG. 10, the transformer 10 principally comprises a magnetic core assembly 41, a bobbin 42, a primary winding coil 43 and a secondary winding coil 44. The magnetic core assembly 41 of the transformer 4 includes a first magnetic part 411 and a second magnetic part 412, which are cooperatively formed as an EE-type core assembly, an EI-type core assembly, an ER-type core assembly, a UU-type core assembly or a UI-type core assembly. The middle portion 411*a* of the first magnetic part 411 and the middle portion 412*a* of the second magnetic part 412 are embedded into the channel 4214 of the bobbin 42. The primary winding coil 43 and the secondary winding coil 44 interact with the magnetic core assembly 41 to achieve the purpose of voltage regulation.

The bobbin 42 comprises a primary winding coil frame 421 and a secondary winding coil frame 422. A primary winding coil 43 is wound around the primary winding coil frame 421. The primary winding coil frame 421 includes a first side plate 4211 and a second side plate 4212. A first winding section 4213 is formed between the first side plate 4211 and the second side plate 4212 for winding the primary winding coil 43 thereon. The primary winding coil frame 421 further includes a first channel 4214 for accommodating the middle portion 411*a* of the second magnetic part 411 therein. The secondary winding coil frame 422 includes a first side plate 4221 and a second side plate 4222. A second winding section 4223 is formed between the first side plate 4221 and the second side plate 4222 for winding the secondary winding coil 44 thereon. The secondary winding coil frame 422 further includes a second channel 4224 for accommodating the middle portion 412*a* of the second magnetic part 412 therein.

The transformer 4 further includes a first adjusting element 46 and a second adjusting element 47 for adjusting the overlap ratio between the primary winding coil 43 and the secondary winding coil 44. The first adjusting element 46 is attached onto the first side plate 4211 of the primary winding coil frame 421. An example of the first adjusting element 46 is a stop block and integrally formed with the primary winding coil frame 421. Alternatively, the first adjusting element 46 may be a stop wall formed by winding an insulating tape around the first winding section 4213. Since a certain space of the first winding section 4213 is occupied by the first adjusting element 46, the remainder of the first winding section 4213 is responsible for winding the primary winding coil 43 thereon. That is, the primary winding coil 43 is wound around the first winding section 4213 between the second side plate 4212 and the first adjusting element 46. After the primary winding coil 43 is wound around the first winding section 4213, the primary winding coil frame 421 is inserted into the second channel 4224 of the secondary winding coil frame 422. It is noted that, however, those skilled in the art will readily observe that numerous modifications and alterations of the first adjusting element 46 may be made while retaining the teachings of the invention. For example, the first adjusting element 46 may be a movable stop block or partition plate.

The second adjusting element 47 is attached onto the second side plate 4222 of the secondary winding coil frame 422. An example of the second adjusting element 47 is a stop block and integrally formed with the secondary winding coil frame 422. Alternatively, the second adjusting element 47 may be a stop wall formed by winding an insulating tape around the second winding section 4223. In some embodiments, the second adjusting element 47 may be a movable stop block or partition plate. Since a certain space of the second winding section 4223 is occupied by the second adjusting element 47, the remainder of the second winding section 4223 is responsible for winding the secondary winding coil 44 thereon. That is, the secondary winding coil 44 is wound around the second winding section 4223 between the first side plate 4221 and the second adjusting element 47.

From the above description, the overlap ratio between the primary winding coil 43 and the secondary winding coil 44 is adjusted by changing the width and the location of the first adjusting element 46 and/or the second adjusting element 47. After a specific overlap ratio is selected, the coupling coefficient and the leakage inductance of the transformer 4 are determined.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer having adjustable leakage inductance, said transformer comprising:

a primary winding coil;

a secondary winding coil;

a bobbin including a winding section for winding said primary winding coil and said secondary winding coil thereon, wherein said bobbin further includes a channel therein; and a magnetic core assembly partially embedded into said channel of said bobbin, wherein said primary winding coil and said secondary winding coil are partially overlapped with each other and wound around said winding section of said bobbin to be defined as an overlap region, the region where said primary winding coil and said secondary winding coil are not overlapped with each other is defined as a non-overlap region, and the leakage inductance of said transformer is adjusted according to an overlap ratio of said overlap region to the sum of said overlap region and said non-overlap region.

2. The transformer according to claim 1 wherein said magnetic core assembly includes a first magnetic part and a second magnetic part, which are cooperatively formed as an EE-type core assembly, an EI-type core assembly, an ER-type core assembly, a UU-type core assembly or a UI-type core assembly.

3. The transformer according to claim 1 wherein said bobbin further includes a first side plate and a second side plate, and said winding section is arranged between said first side plate and said second side plate.

4. The transformer according to claim 3 wherein said primary winding coil is separated from said secondary winding coil by an insulating element, and said insulating element is an insulating tape.

5. The transformer according to claim 4 further including a first adjusting element attached onto said first side plate or said second side plate and disposed between said first side plate and said second side plate, wherein said first adjusting element is a stop block and integrally formed with said bobbin or a stop wall formed by winding an insulating tape around said bobbin.

6. The transformer according to claim 5 wherein said primary winding coil is wound around said winding section between said first adjusting element and said second side plate or between said first adjusting element and said first side plate, and said insulating element is wound around said primary winding coil and said first adjusting element.

7. The transformer according to claim 6 further including a second adjusting element attached onto said first side plate or said second side plate and disposed on said insulating element and between said first side plate and said second side plate, wherein said second adjusting element is a stop block and integrally formed with said bobbin or a stop wall formed by winding an insulating tape around said winding section, and said secondary winding coil is wound around said winding section between said second adjusting element and said first side plate or between said second adjusting element and said second side plate.

8. The transformer according to claim 6 wherein said secondary winding coil is wound around said winding section between said first side plate and said second side plate.

9. The transformer according to claim 4 wherein said primary winding coil is wound around said winding section between said first side plate and said second side plate, and said insulating element is wound around said primary winding coil.

10. The transformer according to claim 9 further including a second adjusting element disposed on said insulating element and between said first side plate and said second side plate, wherein said second adjusting element is a stop block movably attached onto said first side plate or said second side plate or a stop wall formed by winding an insulating tape, and said secondary winding coil is wound around said winding section between said second adjusting element and said first side plate or between said second adjusting element and said second side plate.

11. The transformer according to claim 4 further including a first adjusting element disposed between said first side plate and said second side plate and distant from said first side plate and said second side plate, wherein said first adjusting element is a stop block integrally formed with said bobbin or a stop wall formed by winding an insulating tape around said bobbin, said primary winding coil is wound around said winding section between said first adjusting element and said second side plate such that a first portion thereof is substantially at the same level as said first adjusting element and a second portion thereof is higher than said first adjusting element with respect to said bobbin, and said insulating element is wound around said first portion of said primary winding coil and said first adjusting element.

12. The transformer according to claim 11 further including a second adjusting element disposed between said first side plate and said second side plate and distant from said first side plate and said second side plate, wherein said second adjusting element is a stop block attached onto an edge of said insulating element or a stop wall formed by winding an insulating tape around an edge of said insulating element, said second portion of said first winding coil is wound around said winding section between said second adjusting element and said second side plate, and said secondary winding coil is wound around said winding section between said second adjusting element and said first side plate.

13. The transformer according to claim 4 further including a first adjusting element disposed between said first side plate and said second side plate and distant from said first side plate and said second side plate, wherein said first adjusting element is a stop block integrally formed with said bobbin or a stop wall formed by winding an insulating tape around said bobbin, said primary winding coil is wound around said winding section between said first adjusting element and said second side plate, said insulating element is wound around said first adjusting element and said primary winding coil, a first portion of said secondary winding coil is wound around said insulating element, and a second portion of said secondary winding coil is wound around said winding section between said second adjusting element and said first side plate.

14. The transformer according to claim 4 wherein a first portion of said primary winding coil is partially wound around said winding section from said first side plate, and said insulating element is arranged on said first portion of said primary winding coil.

15. The transformer according to claim 14 further including a second adjusting element disposed between said first side plate and said second side plate and distant from said first side plate and said second side plate, wherein said second adjusting element is a stop block attached onto an edge of said insulating element or a stop wall formed by winding an insulating tape around an edge of said insulating element, a second portion of said primary winding coil is wound around said winding section between said second adjusting element and said second side plate, and said secondary winding coil is wound around said insulating element and between said first side plate and said second adjusting element.

16. The transformer according to claim 1 wherein said bobbin comprises:

a primary winding coil frame for winding said primary winding coil thereon, and including a first side plate, a second side plate, a first winding section and a first channel, wherein said first winding section is arranged between said first side plate and said second side plate; and a secondary winding coil frame for winding said secondary winding coil thereon, and including a first side plate, a second side plate, a second winding section and a second channel, wherein said second winding section is arranged between said first side plate and said second side plate.

17. The transformer according to claim 16 wherein said primary winding coil frame further includes a first adjusting element arranged in said first winding section, and said primary winding coil is wound around said first winding section between said first side plate of said primary winding coil frame and said first adjusting element or between said second side plate of said primary winding coil frame and said first adjusting element.

18. The transformer according to claim 17 wherein said secondary winding coil frame further includes a second adjusting element arranged in said second winding section, and said secondary winding coil is wound around said second winding section between said first side plate of said secondary winding coil frame and said second adjusting element or between said second side plate of said secondary winding coil frame and said second adjusting element.

* * * * *